US008726883B2

(12) United States Patent
Lei et al.

(10) Patent No.: US 8,726,883 B2
(45) Date of Patent: May 20, 2014

(54) IGNITION CONTROL DEVICE FOR USE WITH LIGHT DUTY GASOLINE ENGINE AND METHOD OF SUPPRESSING REVERSE ROTATION OF THE ENGINE

(75) Inventors: Deyou Lei, Shangyu (CN); Jiang Li, Shangyu (CN); Meijun Zheng, Shangyu (CN); Jiangang Dong, Shangyu (CN)

(73) Assignee: Shao Xing Fenglong Electrical Machinery Co., Ltd., Shangyu, Zhejiang Province (CN)

( * ) Notice: Subject to any disclaimer, the term of this patent is extended or adjusted under 35 U.S.C. 154(b) by 1100 days.

(21) Appl. No.: 12/717,710

(22) Filed: Mar. 4, 2010

(65) Prior Publication Data

US 2011/0023825 A1 Feb. 3, 2011

(30) Foreign Application Priority Data

Jul. 28, 2009 (CN) ..... 2009 1 0055513

(51) Int. Cl.
*F02P 11/02* (2006.01)
*F02P 7/067* (2006.01)
*F02P 1/00* (2006.01)

(52) U.S. Cl.
CPC . *F02P 7/067* (2013.01); *F02P 1/00* (2013.01); *F02P 11/02* (2013.01); *F02D 2250/06* (2013.01)
USPC ..... 123/406.56; 123/603; 123/631

(58) Field of Classification Search
CPC ..... F02P 1/00; F02P 11/02; F02P 7/067; F02D 2250/06
USPC ..... 123/406.56, 599, 603, 605, 617, 618, 123/621, 630, 631, 648, 406.53
See application file for complete search history.

(56) References Cited

U.S. PATENT DOCUMENTS

| | | | |
|---|---|---|---|
| 4,924,831 | A | 5/1990 | Piteo et al. |
| 5,392,753 | A | 2/1995 | Burson et al. |
| 6,799,557 | B2 | 10/2004 | Fewell, Jr. et al. |
| 7,040,282 | B2 | 5/2006 | Andersson et al. |
| 7,136,742 | B2 | 11/2006 | Andersson et al. |
| 7,198,028 | B2 | 4/2007 | Andersson et al. |
| 8,150,606 | B2 * | 4/2012 | Kiessling et al. ..... 701/113 |

* cited by examiner

*Primary Examiner* — Hai Huynh
(74) *Attorney, Agent, or Firm* — Greer, Burns & Crain, Ltd.

(57) ABSTRACT

An ignition control device and corresponding method are provided for suppressing reverse rotation of the engine during startup process of a light duty gasoline engine, the ignition control device includes: a charge coil, a transformer, an electric-spark-generating control circuit, a trigger coil, a position sensing circuit, and a micro-controller. The position sensing circuit is used to shape the positive signal and negative signal of the second alternating current signal induced by the trigger coil while the fly wheel rotates respectively to generate a first position signal and a second position signal. According to the first position signal and the second position signal, it is determined by the micro-controller whether the engine is in the state of reverse rotation, and if YES, output of the ignition signal is stopped to make engine halt due to absence of reverse power.

13 Claims, 12 Drawing Sheets

IGNITION CONTROL DEVICE FOR USE WITH LIGHT DUTY GASOLINE ENGINE AND METHOD OF SUPPRESSING REVERSE ROTATION OF THE ENGINE

BACKGROUND

The present invention relates to the light duty gasoline engine, and particularly to the ignition control device for use with light duty gasoline engine and method of suppressing reverse rotation of the engine during startup process of the light duty gasoline engine.

Gasoline Engine always needs an ignition signal from an igniter on an appropriate time point, and power is provided, by combustion of Fuel-Air Mixture in the cylinder in control, to keep gasoline engine running continuously. For light duty gasoline engine, Electronic Fuel Injection (EFI) is rarely used, whereas Ignition Advance Angle of the engine is controlled separately to implement the corresponding control functions. The moment when Fuel-Air Mixture is compressed to its possible minimum volume by Piston in the cylinder is called the Top Dead Center (TDC). In principle, it is needed to get a full burn for Fuel-Air Mixture when Top Dead Center occurs so as to generate the energy to push the piston furthest to bring about a maximum power for the Gasoline Engine. But it takes time for igniter to generate an ignition signal and for Fuel-Air Mixture to be ignited and get a full burn. If the igniter always generate the ignition signal at Top Dead Center (TDC), then with a growing rotation speed of the Gasoline Engine, the time interval between the moment that Fuel-Air Mixture gets a full burn in the cylinder and the moment that Piston arrives at Top Dead Center (TDC) becomes bigger and bigger, and consequently, work efficiency of the Gasoline Engine becomes lower and lower.

Besides, light duty gasoline engine is generally designed in a unidirectional rotation mode, namely, light duty gasoline engine can only rotate in one way. And rotation axis and startup wheel of the gasoline engine are closely jointed in the unidirectional mode. That is, if gasoline engine rotates positively, rotation axis can run normally regardless of the startup wheel; if gasoline engine rotates reversely, rotation axis will run in a reverse way forcing startup wheel to follow it. The startup wheel is wound by a certain length of startup rope so that some positive rotation energy is forced onto the rotation axis and the fly wheel of the gasoline with the startup rope being pulled and with cooperation of the igniting function of igniter, engine can be started normally. During the start-up process of the engine, the speed of rotation axis varies, which will leads that ignition angle calculated by ignition system (particularly for the digital ignition system) to deviate the actually required angle, or even lead to a transient reverse rotation of the rotation axis of the gasoline engine. A reverse rotation of startup wheel causes that the startup rope may more and more tighter with its reverse rotation, and the startup rope may be broken to cause a damage to the startup system once tension goes too much for the startup rope.

SUMMARY

The invention is proposed to solve the aforementioned problems in the existing technology. It proposes an ignition control device for suppressing engine's reverse rotation and generating an ignition signal at a right time point depending on the speed of the engine to control a spark plug to generate a spark for ignition of the light duty gasoline engine, and method of suppressing engine's reverse rotation during the startup process of the light duty gasoline engine.

According to one embodiment of the present invention, there is provided an ignition control device for use with light duty gasoline engine, which control a spark plug to generate a spark for ignition of the light duty gasoline engine, wherein said ignition control device comprises: a charge coil configured to induce a first alternating current signal with rotation of a fly wheel, the surface of said fly wheel comprising a magnetic steel; a transformer comprising a primary ignition coil and a secondary ignition coil, wherein said secondary ignition coil is connected with said spark plug; an electric-spark-generating control circuit configured to receive said rectified first alternating current signal and apply a first signal to said primary ignition coil in response to a ignition signal, wherein said secondary ignition coil induces a second signal to control said spark plug to generate a spark; a trigger coil configured to induce a second alternating current signal with rotation of said fly wheel; a position sensing circuit configured to shape the positive signal and negative signal of said second alternating current signal respectively to generate a first position signal and a second position signal, and provide said first position signal and said second position signal to a micro-controller; the micro-controller configured to determine an ignition moment according to said first position signal to provide said ignition signal to said electric-spark-generating control circuit, and further configured to control said spark plug to stop igniting according to said first position signal and said second position signal.

Optionally, said micro-controller is further configured to sample said first position signal and said second position signal; and control said spark plug to stop igniting if said second position signal is a high level signal and said first position signal is a low level signal.

Optionally, said position sensing circuit comprises a first rectifying unit, a first voltage-dividing unit, a first voltage-stabilizing unit, a second rectifying unit, a second voltage-dividing unit and a second voltage-stabilizing unit, wherein said first rectifying unit, said first voltage-dividing unit and said first voltage-stabilizing unit are configured to shape the positive signal of said second alternating current signal into said first position signal and provide said first position signal to said micro-controller, and said second rectifying unit, said second voltage-dividing unit and said second voltage-stabilizing unit are configured to shape the negative signal of said second alternating current signal into said second position signal and provide said second position signal to said micro-controller; wherein said shaping of the positive/negative signal includes rectification, voltage-division, and voltage-stabilization of the positive/negative signal.

Optionally, said position sensing circuit further comprises a first filter unit and a second filter unit, and said first filter unit is configured to filter said first position signal and provide said filtered first position signal to said micro-controller, and said second filter unit is configured to filter said second position signal and provide said filtered second position signal to said micro-controller.

In the ignition control device according to one embodiment of the present invention, the position sensing circuit shapes the positive signal and negative signal of the second alternating current signal so as to generate the first position signal and the second position signal and provides the first position signal and the second position signal to the micro-controller; and the micro-controller judges whether the engine is in a state of reverse rotation according to the first position signal and second position signal. If the engine is in reverse rotation, micro-controller stops outputting the ignition signal so as to control the spark plug to stop igniting, which makes the engine stop due to absence of power so as to avoid further damage to other parts of the engine.

Besides, in the ignition control device according to another embodiment of the present invention, micro-controller calculates current speed of rotation for the engine on the basis of the first signal, and determines the ignition moment on the basis of the current speed of rotation for the engine to provide the electric-spark-generating control circuit with the ignition signal at the exact ignition moment so as to control the spark plug to generate electric spark for ignition of the light duty gasoline engine. Since the moment that the micro-controller outputs an ignition signal is determined according to current speed of rotation of the engine, when the rotation of the engine is at a low speed, micro-controller outputs the ignition signal just around the top dead center for the ignition of the spark plug, and when the rotation of the engine is at a high speed, micro-controller outputs the ignition signal at a certain moment ahead of top dead center for the ignition of the spark plug, which ensures that Fuel-Air Mixture in the cylinder just gets a full burn when the top dead center arrives and the consequently generated energy may push the piston to move to its furthest extent, which makes gasoline engine produce the biggest power.

Optionally, wherein said electric-spark-generating control circuit comprises a electronic switch unit and a energy storage unit, and said energy storage unit is configured to store said rectified first alternating current signal, and said electronic switch unit is configured to be switched on in response to said ignition signal from said micro-controller so that said energy storage unit discharges to apply said first signal to said primary ignition coil.

Optionally, said electronic switch unit comprises a first resistor set and a thyristor, and the cathode and anode of said thyristor are connected across two terminals of said charge coil, and the gate of said thyristor is connected, via said first resistor set, to an ignition control port of said micro-controller, from which said ignition signal is output, and the gate of said thyristor is further connected to an auxiliary ignition control port of said micro-controller via a conducting wire; wherein said micro-controller is configured to control said ignition control port to output a high level signal and set said auxiliary ignition control port to be in a high-impedance state in time of need of ignition from said spark plug, and to control said ignition control port and said auxiliary ignition control port to output a low level signal when no ignition from said spark plug is needed.

In an ignition control device according to an embodiment of the present invention, while the gate of the thyristor is connected, via the first resistor set, to an ignition control port from which the micro-controller outputs the ignition signal, it is also connected to the auxiliary ignition control port of the micro-controller via a conducting wire. In time of need of ignition, since a high-impedance state is set at the auxiliary ignition control port by said micro-controller, it may be deemed that the gate of the thyristor is not connected with the auxiliary ignition control port at all; and the ignition control port is controlled to output a high level signal by the micro-controller, that is, the thyristor goes into a conducting state after the ignition signal is launched, so that the energy storage unit discharges to apply the first signal to the primary ignition coil, and the secondary ignition coil induces the second signal to control the spark plug to generate a spark. When there is no need of ignition, the micro-controller controls the ignition control port and the auxiliary ignition control port to output low level signals, and since the auxiliary ignition control port outputs a low level signal, the gate of the thyristor is pulled to logic low, which shuts down the thyristor effectively to avoid that the thyristor is mis-trigged to be in conducting state by the electromagnetic interference in the ignition system in case of high temperature of the thyristor.

According to an embodiment of the present invention, there is provided a method of suppressing reverse rotation of an engine during startup of a light duty gasoline engine, comprising: a. shaping the positive signal and the negative signal of a second alternating current signal respectively to generate a first position signal and a second position signal, wherein said second alternating current signal is induced by a trigger coil with rotation of a fly wheel, and said shaping of the positive signal and the negative signal includes rectification, voltage-division, and voltage-stabilization of the positive signal and the negative signal; b. determining whether said engine is in reverse rotation according to said first position signal and second position signal; c. control a spark plug to stop igniting if said engine is rotating reversely.

Optionally, the step b comprises: i. detecting said first position signal and said second signal respectively; ii. determining that said engine is in reverse rotation, if said first position signal is a low level signal and said second position signal is a high level signal; iii. determining that said engine is in positive rotation, if said first position signal is a high level signal and said second position signal is a low level signal.

By applying the method according to the above embodiment, it may be effectively judged whether the engine is in a state of reverse rotation, which helps to control the spark plug to stop igniting so as to make the engine stop due to absence of power to avoid further damage to other parts of the engine.

BRIEF DESCRIPTION OF THE DRAWINGS

Other features, aspects and advantages of the present invention will become obvious by reading the following description of the non-limited embodiments with the aid of appended drawings. Wherein, same or similar reference numerals refer to the same or similar steps or means.

Wherein, same or similar drawing reference signs represent same or similar steps/device (module), respectively.

DETAILED DESCRIPTION

Details are provided for the embodiments of the present invention as follows in conjunction with appended drawings.

Figure 1:
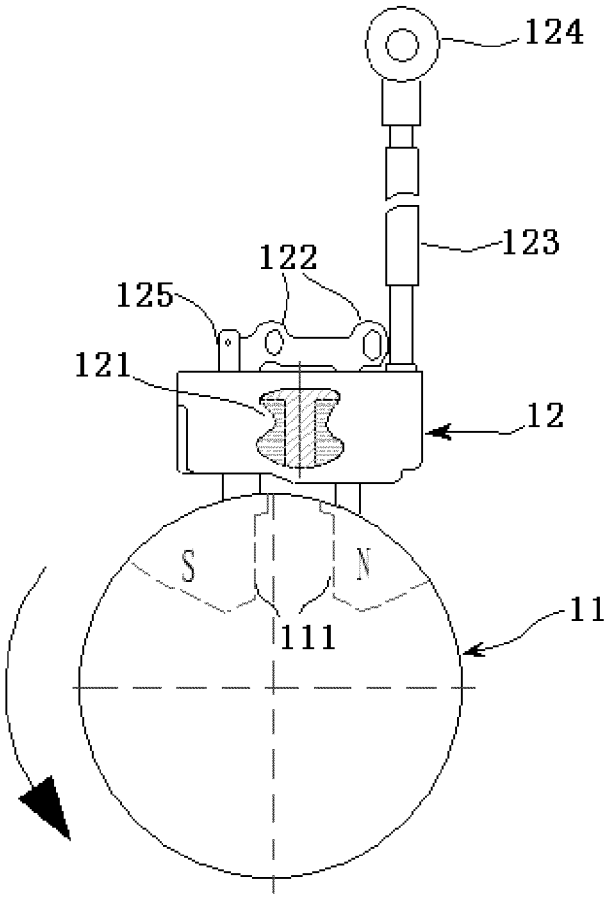
FIG. 1 is the topological diagram of an ignition assembly for a light duty gasoline engine according to an embodiment of the present invention.

FIG. 1 is the topological diagram of an ignition assembly for a light duty gasoline engine according to an embodiment of the present invention. Without loss of generality, the ignition assembly in FIG. 1 comprises a fly wheel 11 and an igniter 12.

The fly wheel 11 is installed around the axis of engine (not shown in FIG. 1), and rotates following the rotation of the axis of the engine. The fly wheel 11 is embedded with magnetic steel 111 in its surface, and magnetic pole S and N of the magnetic steel 111 is located on the surface of the fly wheel 11.

The igniter 12 comprises a coil 121, an iron core 122, a high voltage wire 123, a high voltage cap 124, a killing tablet 125. The coil 121 is a coil group wound around the iron core 122, which comprises a charge coil, a trigger coil, a primary ignition coil, and a secondary ignition coil (not shown in FIG. 1).

When the fly wheel 11 rotates following the rotation of the axis of the engine, periodically the pole S and pole N of the magnetic steel 111 in its surface alternatively pass through the area where the igniter 12 is located, so that the charge coil wound around the iron core 122 induces the first alternative current signal, and the trigger coil induces the second alternative current signal. As the number of windings of the trigger coil is farther less than that of the charge coil, the second alternative current signal is more less than the first alternative current signal. And power for ignition of spark plug (not depicted in FIG. 1) is provided by the first alternative current signal, and power for the normal operation of the micro-controller is provided by the micro-controller (not depicted in FIG. 1).

The high voltage cap 124 is capped on the spark plug of the engine, and is connected to the secondary ignition coil inside the igniter 12 via the metal wire inside the high voltage wire 123 (not depicted in FIG. 1). When the micro-controller outputs the ignition signal, a pulse voltage is applied on the primary ignition coil, which induces a high voltage of tens of thousands of volts which is sent to the spark plug via the high voltage wire 123 to control the spark plug to generate spark for ignition of the light duty gasoline engine.

According to one embodiment of the present invention, the moment that the micro-controller outputs an ignition signal is determined according to the current speed of rotation of the engine. When the rotation of the engine is at a low speed, micro-controller outputs the ignition signal just around the top dead center for the ignition of the spark plug, and when the rotation of the engine is at a high speed, micro-controller outputs the ignition signal at a certain moment ahead of top dead center for the ignition of the spark plug, which ensures that Fuel-Air Mixture in the cylinder just gets a full burn when the top dead center arrives and the consequently generated energy may push the piston to move to its furthest extent, which makes gasoline engine produce the biggest power.

The killing tablet 125 is located around the iron core 122, and optionally, a switch is connected in series between the killing tablet 125 and the iron core 122. As long as the switch is operated to be on by the user, a short circuit is made between the killing tablet 125 and the iron core 122, which can be identified by the micro-controller, so as to stop outputting the ignition signal to control the spark plug to stop igniting.

It should be noted that, there are only showed in FIG. 1 some major parts of the ignition assembly for light duty gasoline engine, and it can be understood by those skilled in the art that, in particular application, other parts can be included into the ignition assembly.

Figure 2:
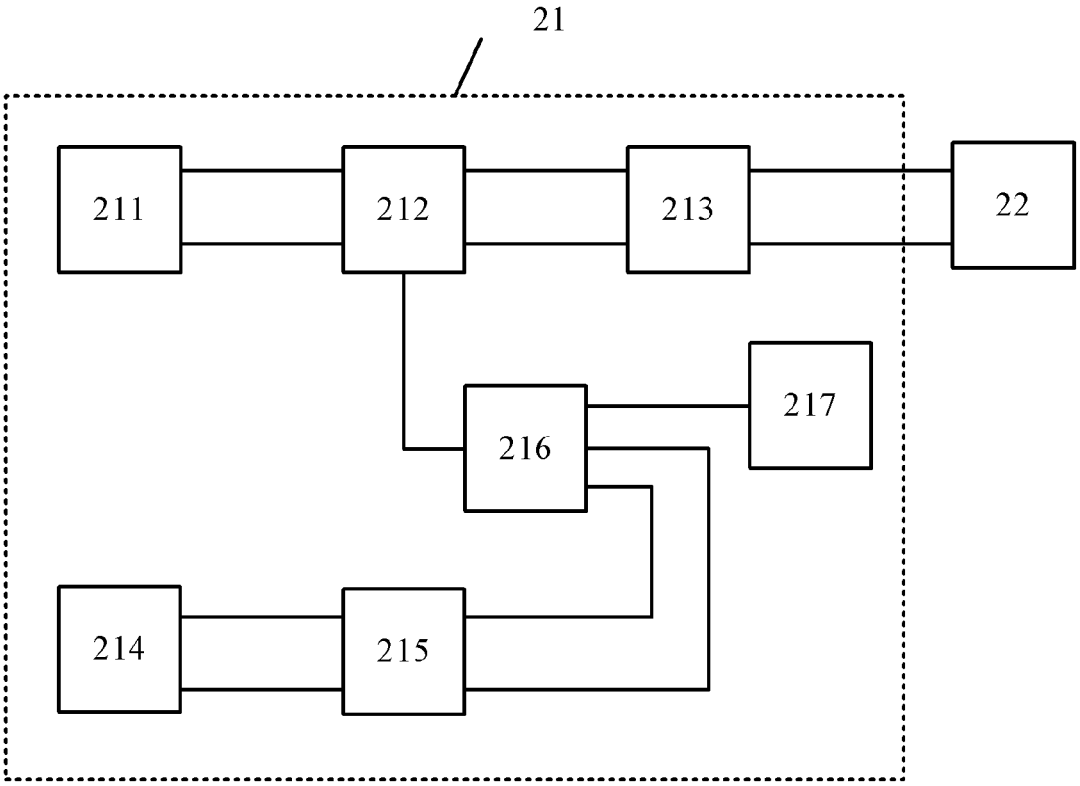
FIG. 2 is the block diagram of an ignition control device for a light duty gasoline engine according to an embodiment of the present invention.

FIG. 2 is the block diagram of an ignition control device for a light duty gasoline engine according to an embodiment of the present invention. In FIG. 2, what is enclosed by the dot line refers to an ignition control device 21 comprising a charge coil 211, an electric-spark-generating control circuit 212, a transformer 213, a trigger coil 214, a position sensing circuit 215, a micro-controller 216, a killing control circuit 217.

The ignition control device 21, showed in FIG. 2, is actually the igniter 12 showed in FIG. 1, wherein the ignition control device 21 is used to control the spark plug 22 to generate spark for ignition of the light duty gasoline engine.

It should be noted that, some circuit modules for the preferable embodiments are also included in the ignition control device 21 showed in FIG. 2, and it should be understood by those skilled in the art that the killing control circuit 217 is optional for the ignition control device 21.

When the fly wheel (not depicted in FIG. 2) rotates following rotation of the axis of the engine, the first alternative current signal is induced on the charge coil 211 and the second alternative current signal is induced on the trigger coil 214. As the number of windings of the trigger coil 214 is farther less than that of the charge coil 211, the second alternative current signal is more less than the first alternative current signal.

It should be noted that, although the charge coil 211 and the trigger coil 214, showed in FIG. 2, is separate physically, yet, in particular application, the charge coil 211 and the trigger coil 214 may be one coil.

The transformer 213 comprises a primary ignition coil and a secondary ignition coil (not depicted in FIG. 2), and the secondary ignition coil is connected with the spark plug 22.

The electric-spark-generating control circuit 212 is arranged between the charge coil 211 and the transformer 213, which is configured to receive the rectified first alternating current signal from the charge coil 211 and apply a first signal to the primary ignition coil of the transformer 213 in response to the ignition signal. The secondary ignition coil induces a second signal to control the spark plug 22 to generate a spark.

It should be noted that, a rectification circuit is arranged between the charge coil 211 and the electric-spark-generating control circuit 212, which is configured to rectify the first alternating current signal induced by the charge coil 211, and then provide the first alternating current signal to the electric-spark-generating control circuit 212.

The position sensing circuit 215 is connected with the trigger coil 214, which is configured to shape the positive signal and negative signal of the second alternating current signal from the trigger coil 214 to generate the first position signal and the second position signal, and provide the first position signal and the second position signal to the micro-controller 216.

The micro-controller 216 is configured to generate an ignition signal according to the first position signal provided by the position sensing circuit 215 and provide the electric-spark-generating control circuit 212 with the ignition signal, and also configured to control the spark plug 22 to stop igniting according to the first position signal and the second position signal provided by position sensing circuit 215.

To be specific, the micro-controller 216 judges whether the engine is in a state of reverse rotation according to the first position signal and second position signal. If the engine rotates reversely, the micro-controller 216 stops outputting the ignition signal to control the spark plug 22 to stop igniting.

Optionally, after receiving the first position signal and the second position signal from position sensing circuit 215, the micro-controller 216 samples the first position signal and the second position signal. If the second position signal is a high level signal and the first position signal is a low level signal, then the micro-controller 216 determines that the engine is in a state of reverse rotation and stops outputting the ignition signal.

It should be noted that, the state of reverse rotation of the engine is represented by the case that the second position signal is a high level signal and the first position signal is a low level signal, which is merely an example for explanation, and in some other specific applications, the state of reverse rotation of the engine may also be represented by the case that the second position signal is a low level signal and the first position signal is a high level signal, which can be easily understood by those skilled in the art and is not elaborated here.

If the micro-controller 216 determines that the engine is in a state of positive rotation, then, the micro-controller 216 calculates the current speed of rotation of the engine according to the first position signal, and then determines the ignition moment according to the current speed of rotation of the engine to provide the electric-spark-generating control circuit 212 with the ignition signal at the exact ignition moment, so as to control the spark plug to generate electric spark for ignition of the light duty gasoline engine.

Optionally, a table is saved in the memory of the micro-controller 216, which represents the mapping relation between the rotation speed and the ignition angle of the engine. After the micro-controller 216 calculates the current speed of rotation of the engine according to the first position signal, and the micro-controller 216 searches the mapping relation table between the rotation speed and the ignition angle of the engine for the ignition angle corresponding to the current speed of rotation of the engine, and then determines the ignition moment according to the ignition angle and provides the electric-spark-generating control circuit 212 with the ignition signal at the ignition moment exactly.

It should be noted that, the mapping relation between the rotation speed and the ignition angle of the engine may vary by different engines. For different engines, the mapping relation between rotation speed and ignition angle of the engine can be adjusted accordingly. Besides, for a specific engine, the mapping relation between the rotation speed and the ignition angle of the engine can be rectified, according to its characteristics, to ensure that best performance can be achieved at different rotation speed of the engine.

The ignition angle refers to the angle between ignition moment and the top dead center. And in practical application, the ignition angle may lie before the top dead center or after it in time domain.

For simplifying the description hereafter, it is supposed that all ignition angles in following cases are greater than 0, which means that the ignition happens before the top dead center arrives.

For instance, when the micro-controller 216 obtains the ignition angle of 25° after searching through the table, the micro-controller 216 should output the ignition signal ahead of the top dead center by 25°.

It should be noted that, the micro-controller 216 can obtain the position of the top dead center according to the first position signal.

The killing control circuit 217 is configured to be responsive to the operation of a user and provide a killing signal to the micro-controller 216, and the micro-controller 216 is also configured to stop outputting the ignition signal so as to control the spark plug to stop igniting according to the killing signal provided by the killing control circuit 217.

A detailed description is as follows for the circuit diagram of the functional blocks in the ignition control device showed in FIG. 2 in combination with FIG. 3~FIG. 8.

Figure 3:
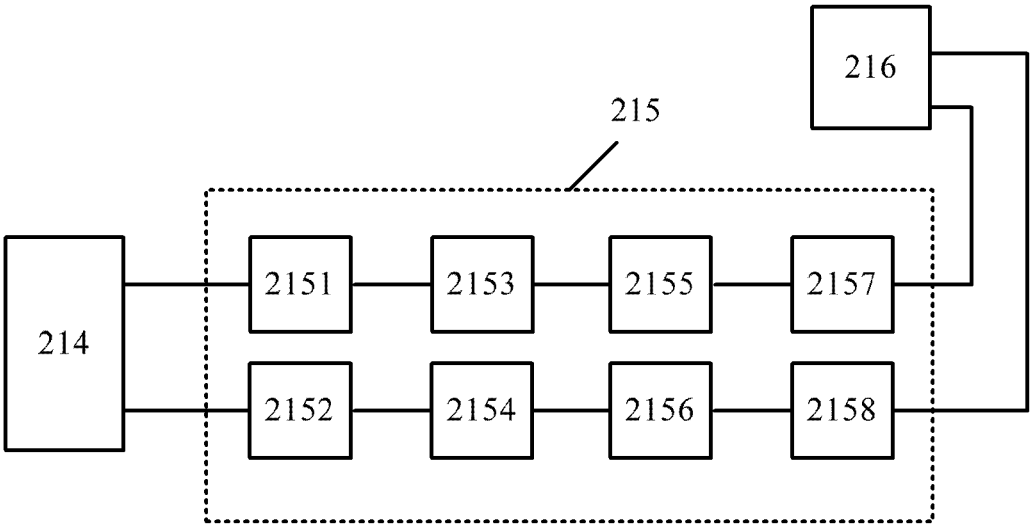
FIG. 3 is the block diagram of a position sensing circuit according to an embodiment of the ignition control device of present invention.

FIG. 3 shows the block diagram of a position sensing circuit 215 according to an embodiment of the ignition control device 21 of the present invention, wherein the partition enclosed by the dot line is the position sensing circuit 215 comprising a first voltage-stabilizing unit 2151, a first rectifying unit 2153, a first voltage-dividing unit 2155, a filter unit 2157, a second voltage-stabilizing unit 2152, a second rectifying unit 2154, a second voltage-dividing unit 2156 and a second filter unit 2158.

The voltage-stabilizing, rectification, voltage-dividing and filtering is applied to the positive signal of the second alternating current signal provided by the trigger coil 214 by the first voltage-stabilizing unit 2151, the first rectifying unit 2153, the first voltage-dividing unit 2155 and the filter unit 2157 to obtain the first position signal and provide the first position signal to the micro-controller 216.

The voltage-stabilizing, rectification, voltage-dividing and filtering is applied to the negative signal of the second alternating current signal provided by the trigger coil 214 by the first voltage-stabilizing unit 2152, the first rectifying unit 2154, the first voltage-dividing unit 2156 and the filter unit 2158 to obtain the second position signal and provide the second position signal to the micro-controller 216.

It should be noted that, some circuit modules for preferable embodiments are also included in the position sensing circuit 215 showed in FIG. 3, and it should be understood by those skilled in the art that the first filter unit 2157 and the second filter unit 2158 are optional, which are configured to filter the high-frequency noise so as to smooth the first position signal and the second position signal which is provided to the micro-controller 216.

It should be further noted that, the function of the first voltage-stabilizing unit 2151 and the second voltage-stabilizing unit 2152 can be implemented by one integrated voltage-stabilizing circuit module.

Figure 4:
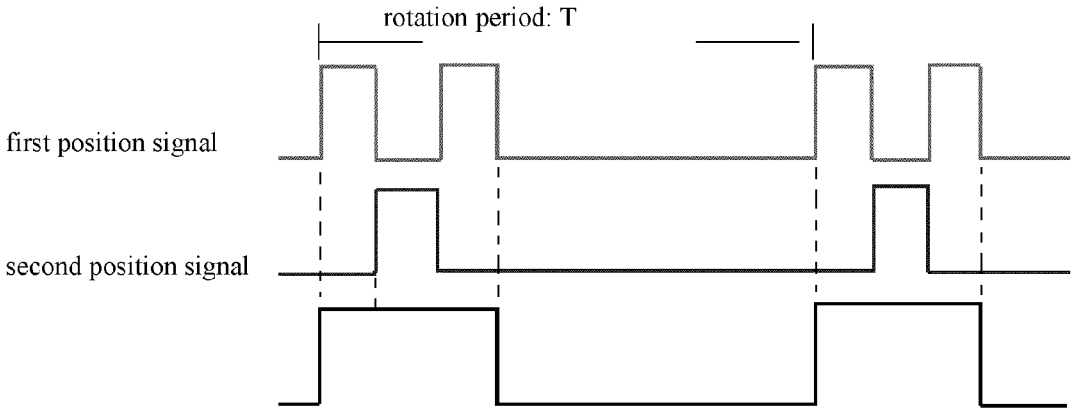
FIG. 4 is wave diagram for the first position signal and second position signal provided to the micro-controller by the position sensing circuit when the engine is in positive rotation.

FIG. 4 shows the wave diagram for the first position signal and second position signal provided to the micro-controller 216 by the position sensing circuit 215 when engine is in positive rotation.

Figure 5:
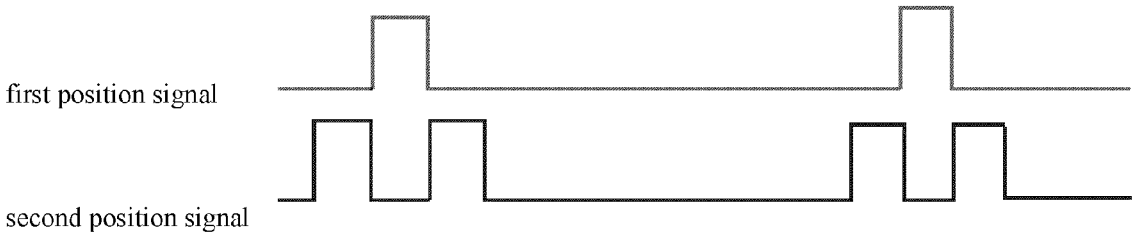
FIG. 5 is wave diagram for the first position signal and second position signal provided to the micro-controller by the position sensing circuit when the engine is in reverse rotation.

FIG. 5 shows the wave diagram for the first position signal and second position signal provided to the micro-controller 216 by the position sensing circuit 215 when engine is in negative rotation.

It should be noted that, description is made merely by the example that wave diagram of the first position signal and the second position signal represents positive rotation of the engine. And it should be understood by those skilled in the art that, in practical application, it can be assumed that wave diagram of the first position signal and second position signal, showed in FIG. 5, represents positive rotation of the engine. For the purpose of simplicity, it is not elaborated here.

It should also be noted that, the wave diagram of the first position signal and the second position signal in FIG. 4 and FIG. 5 is merely a roughly schematic view, while in practical application, the first position signal and the second position signal may have some slope on its rising edge and falling edge.

After receiving the first position signal and the second position signal from the position sensing circuit 215, the micro-controller 216 samples the first position signal and the second position signal. If the first position signal changes from low level to high level before the second position signal changes, as showed in FIG. 4, then the micro-controller 216 determines that the engine is in a state of positive rotation, and if the second position signal changes from low level to high level before the first position signal changes, as showed in FIG. 5, then the micro-controller 216 determines that the engine is in a state of reverse rotation, and accordingly, the micro-controller 216 stops outputting the ignition signal so as to control the spark plug to stop igniting.

If the micro-controller 216 determines that the engine is in a state of positive rotation, that is, the first position signal and the second position signal received by the micro-controller 216 is just as what shown in FIG. 4, then, the micro-controller 216 determines the rotation period T according to the first position signal, wherein the rotation period T represents the interval between the rising edges of the two pulses showed in FIG. 4. Then, the micro-controller 216 determines the current speed of rotation of the engine according to the rotation period T, for example, assuming the rotation period T to be 10 ms, and accordingly, the current speed of rotation of the engine is 6000 r/m. After the determination of the current speed of rotation of the engine, the micro-controller 216 determines the ignition moment according to the current speed of rotation of the engine and provides the electric-spark-generating control circuit 212 with the ignition signal at the exact ignition moment to control the spark plug 22 to generate electric spark for ignition of the light duty gasoline engine.

Optionally, a table is saved in the memory of the micro-controller 216, which represents the mapping relation between the rotation speed and the ignition angle of the engine. After the micro-controller 216 finishes calculating the current speed of rotation of the engine according to the first position signal, the micro-controller 216 looks for the ignition angle corresponding to the current speed of rotation of the engine from the mapping-relation table between the rotation speed and the ignition angle of the engine, and then determines the ignition moment according to the ignition angle and provides the electric-spark-generating control circuit 212 with the ignition signal at the ignition moment exactly.

For example, the ignition moment can be determined by the micro-controller 216 according to the formula below:

$$T_i = A*T/360$$

wherein, T represents rotation period, A represents ignition angle, Ti represents ignition moment, namely, the micro-controller 216 outputs an ignition signal ahead of the top dead center by $T_i$.

Figure 6:
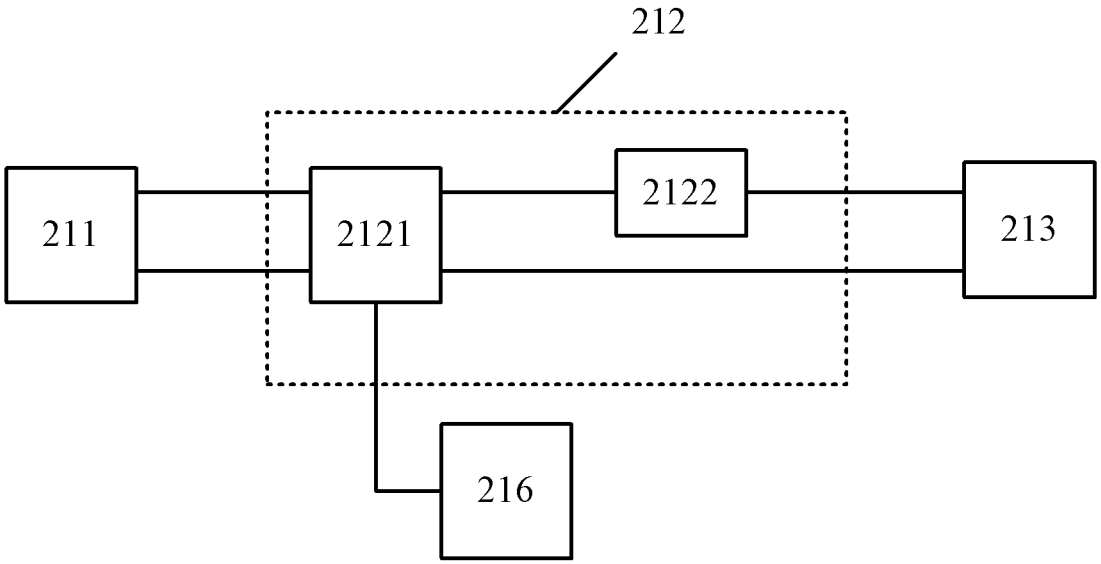
FIG. 6 is the block diagram of the electric-spark-generating control device according to an embodiment of the ignition control device of present invention.

FIG. 6 is the block diagram of the electric-spark-generating control device 212 according to an embodiment of the ignition control device 21 of the present invention, wherein the partition enclosed by the dot line is the electric-spark-generating control device 212 comprising an electronic switch unit 2121 and an energy storage unit 2122.

The energy storage unit 2122 is configured to store the first alternating current signal after rectification.

The electronic switch unit 2121 is configured to be responsive to the ignition signal from the micro-controller 216 and switched on so that the energy storage unit 2122 discharges and applies the first signal to the primary ignition coil in the transformer 213. And the secondary ignition coil induces the second signal to control the spark plug 22 to generate a spark.

Figure 7:
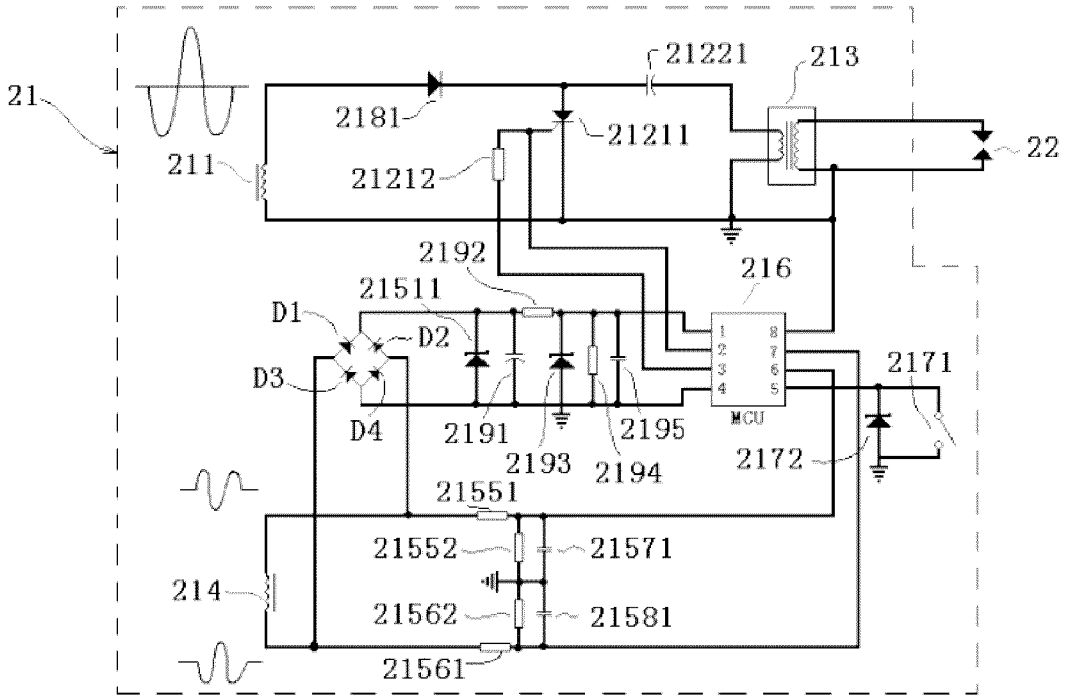
FIG. 7 is the schematic diagram of the ignition control device according to an embodiment of present invention.

Detailed description is made as follows, base on the schematic view of the ignition control device, as shown in FIG. 7, according to an embodiment of the ignition control device of the present invention.

It should be noted that, the schematic view shown in FIG. 7 is merely exemplary, which brings no constraint to the scope of present invention.

The micro-controller 216 as shown in FIG. 7 is an 8-bit MCU of an 8-pin packaging type. Certainly, the micro-controller 216 can be implemented with a MCU of more bits for higher precision. Besides, package type of the micro-controller 216 is not limited to 8-pin, and 6-pin or 14-pin can also work for the package type of the micro-controller 216 to achieve the same ignition function as present invention.

It should be noted that, generally, there is an embedded internal oscillator inside the MCU, and thus, there is no need for an external oscillator, which leads to some simplicity for the present invention.

After the fly wheel (not depicted in FIG. 7) rotates following the rotation of the axis of the engine, the charge coil 211 induces the first alternative current signal and the trigger coil 214 induces the second alternative current signal, wherein, the power for ignition of the spark plug 22 is provided by the first alternative current signal, and the power for the normal operation of the micro-controller 216 is provided by the second alternative current signal which can also provide the position signal to the micro-controller 216.

It should be noted that, although the chargeacoil 211 and trigger coil 214, showed in FIG. 7, is separate physically, yet, in practical application, the charge coil 211 and trigger coil 214 may be integrated into one coil physically.

When the charge coil 211 and trigger coil 214 are separate physically, the number of windings of trigger coil 214 can be selected farther less than that of the charge coil 211, so that the second alternative current signal is much less than the first alternative current signal.

Normally, power supply of 3-5 v should be provided to the MCU. And an appropriate number of windings of the trigger coil 214 can be selected so that the value of the second alternative current signal is within the scope of 10V~20V, and thus, less power components are needed to step down the voltage, which can not only simplify the circuit design but also reduce the power dissipation of components.

As showed in FIG. 7, the first alternative current signal induced on the charge coil 211 is rectified by the diode 2181 to charge the ignition capacitor 21221, wherein, the ignition capacitor 21221 has a high value of permissible voltage The cathode and anode of the thyristor 21211 is connected across the two terminals of the charge coil 211, and the gate of the thyristor 21211 is connected, via the first resistor set 21212, to the ignition control port from which the micro-controller 216 outputs the ignition signal, that is, Pin 3 of the micro-controller 216; and the gate of said tiac 21211 is also connected to the auxiliary ignition control port, that is, Pin 2 of the micro-controller 216 via a conducting wire, wherein the first resistor set 21212 is composed of one or more resistors.

In time of need of ignition, the micro-controller 216 controls Pin 3 to output a high level signal and sets Pin 2 to be a high-impedance state. As Pin 2 is set to be a high-impedance state by the micro-controller 216, it may be deemed that gate of the thyristor 21211 is not connected with Pin 2 at all. And after the micro-controller 216 controls Pin 3 to output a high level signal, that is, output an ignition signal, the thyristor goes into a conducting state, so that the ignition capacitor 21221 discharges to apply the first signal to the primary ignition coil of the transformer 213. And the secondary ignition coil of the transformer 213 induces the second signal to control the spark plug 22 to generate a spark.

When there is no need for ignition, the micro-controller 216 controls Pin 3 and Pin 2 to output low level signals. Since the micro-controller 216 controls Pin 2 to output a low level signal, the gate of the thyristor 21211 is pulled to logic low, which shut down the thyristor 21211 effectively to avoid that the thyristor 21211 is mis-trigged to be in conducting state by the electromagnetic interference in the ignition system in case of high temperature of the thyristor 21211.

In this embodiment, the energy storage unit 2122, as shown in FIG. 6, is made up of the ignition capacitor 21221. The electronic switch unit, as shown in FIG. 6, consists of the first resistor set 21212 and the thyristor 21211.

It should be noted that, the above is merely an embodiment for the circuit modules of the electric-spark-generating control device 212 as shown in FIG. 6, and it should be understood by those skilled in the art that, in practical application, circuit modules of the electric-spark-generating control device 212 as shown in FIG. 6 can have more implementations.

As shown in FIG. 7, the second alternating current signal induced on the trigger coil 214 is rectified to a DC voltage by a full-bridge rectifying circuit made up of the diode D1,D2, D3 and D4.

The DC voltage is stabilized for the first time by the stabilivolt 21511 to charge the electrolytic capacitor 2191. Subsequently, the electrolytic capacitor 2191 discharges via the resistor 2192 and the resistor 2194 to provide power supply to Pin 1 and Pin 8 of micro-controller 216.

The stabilivolt 2193 is configured to stabilize, for the second time, the voltage provided to the micro-controller 216, which can avoid that the voltage is too high to damage the micro-controller 216.

The filter capacitor 2195 is configured to filter the voltage provided to the micro-controller 216 so as to filter the high-frequency noise.

Optionally, the output of the stabilivolt 21511 is 15V, and the output of the stabilivolt 2193 is 4V.

Besides, the positive signal of the second alternating current signal induced on the trigger coil 214 is stabilized by the diode D2 and the stabilivolt 21511, rectified by the diode D3, divided in voltage by the resistor 21551 and the resistor 21552, and filtered by the filter capacitor 21571 to serve as a first position signal to be provided to Pin 6 of the micro-controller 216.

Likely, the negative signal of the second alternating current signal induced on the trigger coil 214 is stabilized by the diode D1 and the stabilivolt 21511, rectified by the diode D4, divided in voltage by the resistor 21561 and the resistor 21562, and filtered by the filter capacitor 21581 to serve as a second position signal to be provided to Pin 7 of the micro-controller 216.

The wave diagram for Pin 6 and Pin 7 of the micro-controller 216 is shown in FIG. 4 and FIG. 5.

In the present embodiment, the first voltage-stabilizing unit 2151 as shown in FIG. 3 consists of the diode D2 and the stabilivolt 21511, the first rectifying unit 2153 as shown in FIG. 3 consists of the diode D3, the first voltage-dividing unit 2155 as shown in FIG. 3 consists of the resistor 21551 and the resistor 21552, the filter unit 2157 as shown in FIG. 3 consists of the filter capacitor 21571; and the second voltage-stabilizing unit 2152 as shown in FIG. 3 consists of the diode D1 and the stabilivolt 21511, the second rectifying unit 2154 as shown in FIG. 3 consists of the diode D4, the second voltage-dividing unit 2156 as shown in FIG. 3 consists of the resistor 21561 and the resistor 21562, and the second filter unit 2158 as shown in FIG. 3 consists of the filter capacitor 21581.

It should be noted that, the above is merely an embodiment for the circuit modules of the position sensing circuit 215 as shown in FIG. 3, and it should be understood by those skilled in the art that, in practical application, circuit modules of the position sensing circuit 215 as shown in FIG. 6 can have more implementations.

By sampling the first position signal on Pin 6 and the second position signal on Pin 7, the micro-controller 216 determines if the engine is in a state of reverse rotation or not. If the first position signal changes from low level to high level before the second position signal changes in the same way, as shown in FIG. 4, then the micro-controller 216 determines that the engine is in a state of positive rotation, and if the second position signal changes from low level to high level before the first position signal changes in the same way, as showed in FIG. 5, then the micro-controller 216 determines that the engine is in a state of reverse rotation.

If micro-controller 216 determines that the engine is in a state of reverse rotation, then the micro-controller 216 controls Pin 3 and Pin 2 to output a low level signal to force the thyristor 21211 into the shut-down state so as to control the spark plug 22 to stop igniting.

If the micro-controller 216 determines that the engine is in a state of positive rotation, then, micro-controller 216 determines the rotation period T according to the first position signal, wherein the rotation period T represents the interval between the rising edges of the two pulses shown in FIG. 4. Then, micro-controller 216 determines the current speed of rotation of the engine according to rotation period T, for example, assuming the rotation period T to be 10 ms, and accordingly, the current speed of rotation of the engine is 6000 r/m. After calculating the current speed of rotation of the engine, the micro-controller 216 determines, according to the current speed of rotation of the engine, the ignition moment to control Pin 3 to output a high level signal and set Pin 2 to be high-impedance state, so that the thyristor 21211 goes into a conducting state which controls the spark plug 22 to generate an electric spark for ignition of the light duty gasoline engine.

Optionally, a table is saved in the memory of the micro-controller 216, which represents the mapping relation between the rotation speed and the ignition angle of the engine. After the micro-controller 216 calculates the current speed of rotation of the engine, the micro-controller 216 looks for the ignition angle corresponding to the current speed of rotation of the engine from the mapping-relation table between the rotation speed and the ignition angle of the engine, and then determines the ignition moment according to the ignition angle to control Pin 3 to output a high level signal and set Pin 2 to be a high-impedance state.

Figure 8:
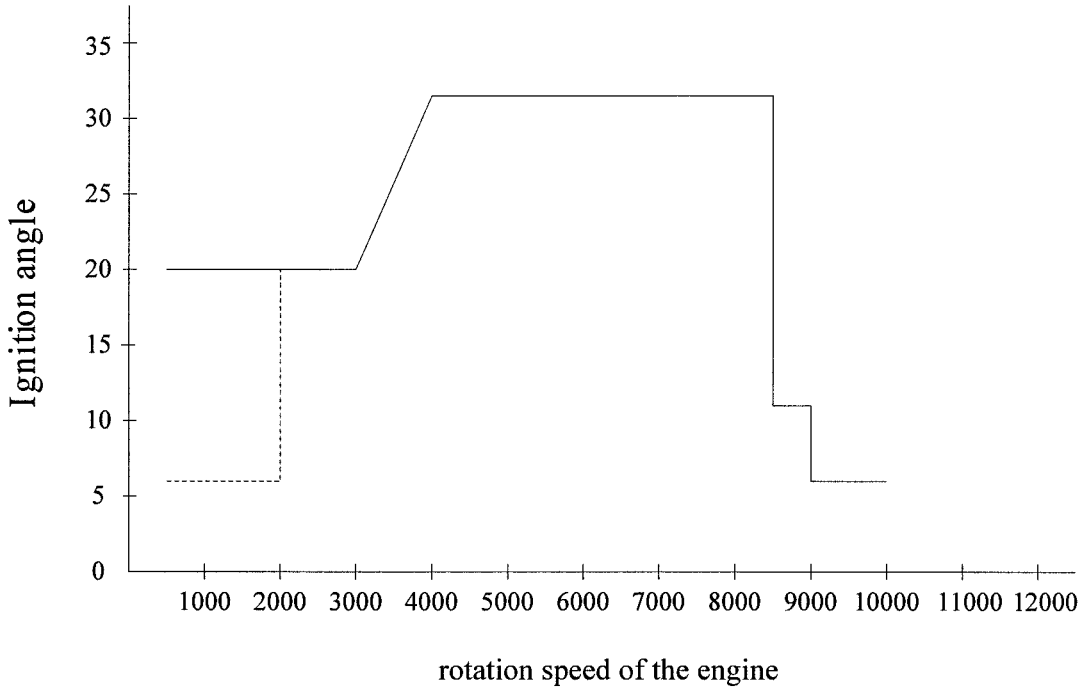
FIG. 8 is the diagram of mapping relation between rotation speed and ignition angle of the engine according to an embodiment of present invention.

FIG. 8 is the diagram of mapping relation between the rotation speed and the ignition angle of the engine according to an embodiment of the present invention, wherein, the horizontal axis represents the rotation speed of the engine, and vertical axis represents the ignition angle.

As shown in FIG. 8, the dot line represents the mapping relation between the rotation speed and the ignition angle of the engine during startup process of light duty gasoline engine, and real line represents the mapping relation between the rotation speed and the ignition angle of the engine during normal operation of the light duty gasoline engine It should be noted that, for simplifying the description, it is supposed that all ignition angles in FIG. 8 is greater than 0, which means that the ignition happens before the top dead center arrives.

It should be understood by those skilled in the art that, in practical application, the ignition angle may be positive or negative, which respectively means that the ignition happens before or after the top dead center arrives.

It should further be noted that, the mapping relation, as shown in FIG. 8, between the rotation speed and the ignition angle of the engine is merely exemplary. For different engines, the mapping relation between the rotation speed and the ignition angle of the engine can be adjusted accordingly.

Optionally, after the micro-controller 216 calculates the current rotation speed of the engine, it will further judge whether the current rotation speed of the engine is greater than a first threshold value. If the current rotation speed of the engine is greater than the first threshold value, the micro-controller 216 temporarily stops outputting the ignition signal for the moment and then continues to output the ignition signal until the rotation speed of the engine is less than the first threshold value.

As shown in FIG. 7, the first terminal of the killing switch 2171 is connected to the GROUND, and the second terminal of the killing switch 2171 is connected to Pin 5 of the micro-controller 216. The first stabilivolt 2172 is connected to the second terminal of the killing switch 2171 to ensure that the voltage provided to Pin 5 of the micro-controller 216 can not go too high to cause damage to Pin 5.

Inside the micro-controller 216, Pin 5 is connected to Pin 1 via a resistor. Alternatively, Pin 5 can also be connected to Pin 1 via an external resistor outside of the micro-controller 216.

When the killing switch 2171 is out of use, namely, it is not switched on by the user, then Pin 5 of the micro-controller 216 is logic high. When the killing switch 2171 is switched on by the user, Pin 5 of the micro-controller 216 is pulled to logic low for the first terminal of the killing switch 2171 being connected to the GROUND. After the micro-controller 216 detects the logic low on its Pin 5, it stops outputting the ignition signal to stop the engine.

It should be noted that, the first stabilivolt 2172 is a optional element.

In the present embodiment, the killing control circuit 217, as shown in FIG. 2, consists of the killing switch 2171 and the first stabilivolt 2172.

It should be noted that, the above is merely an embodiment for the killing control circuit 217 as shown in FIG. 2, and it should be understood by those skilled in the art that, in practical application, the killing control circuit 217 as shown in FIG. 2 can have more implementations.

Figure 9A:
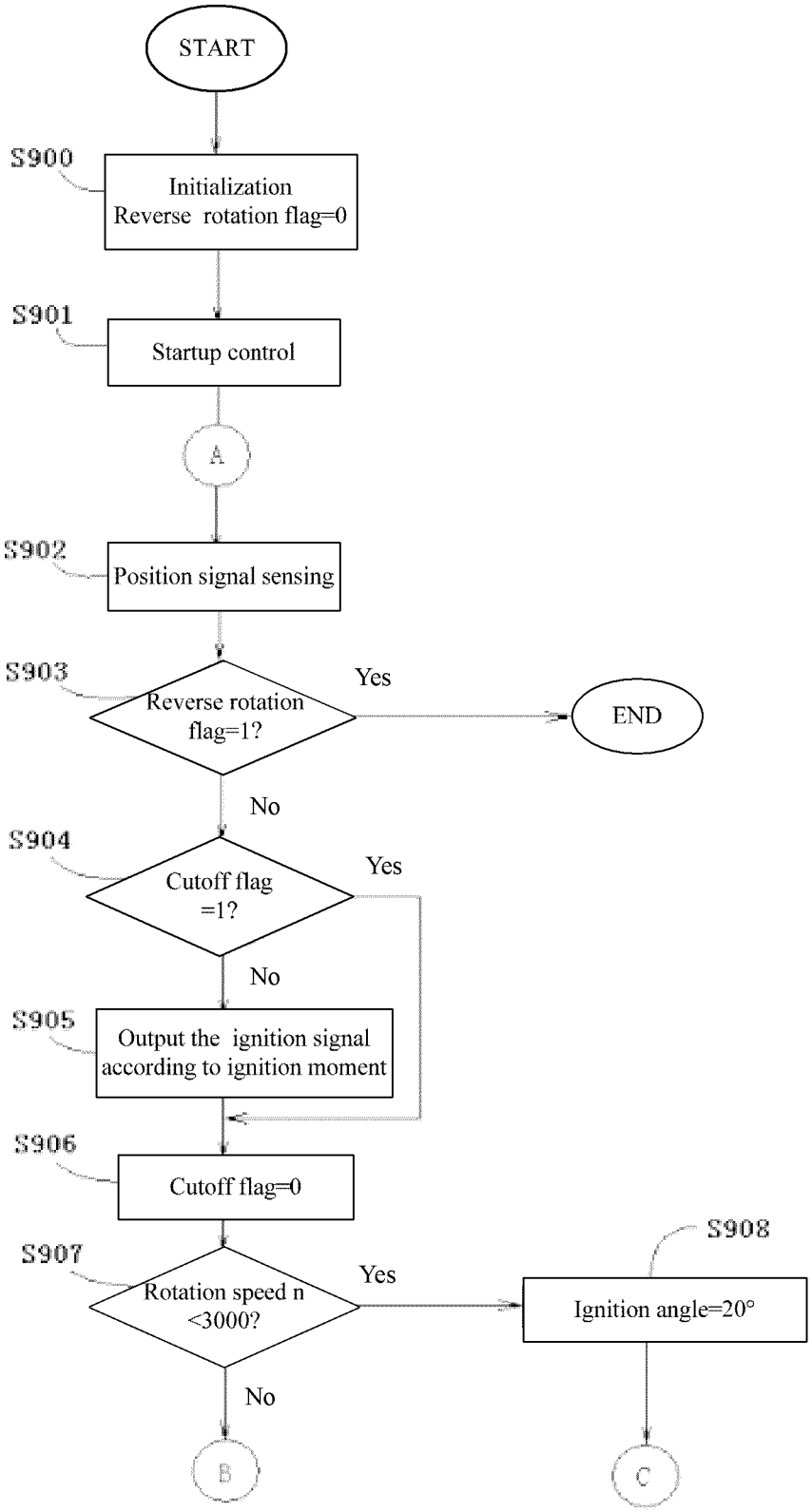
FIG. 9*a* and FIG. 9*b* are flow charts of ignition control according to an embodiment of the invention.
Figure 9B:
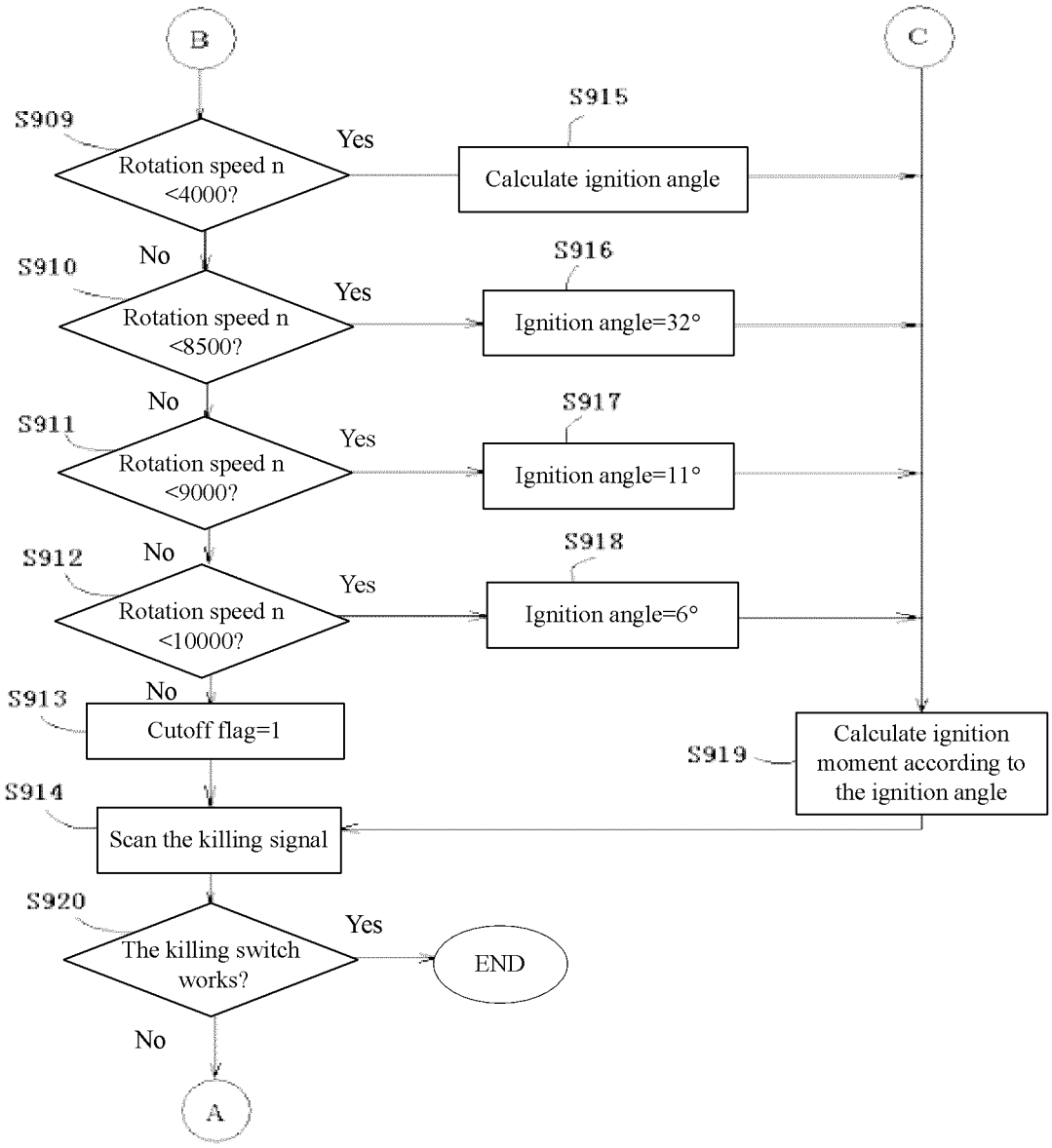
Figure 10:
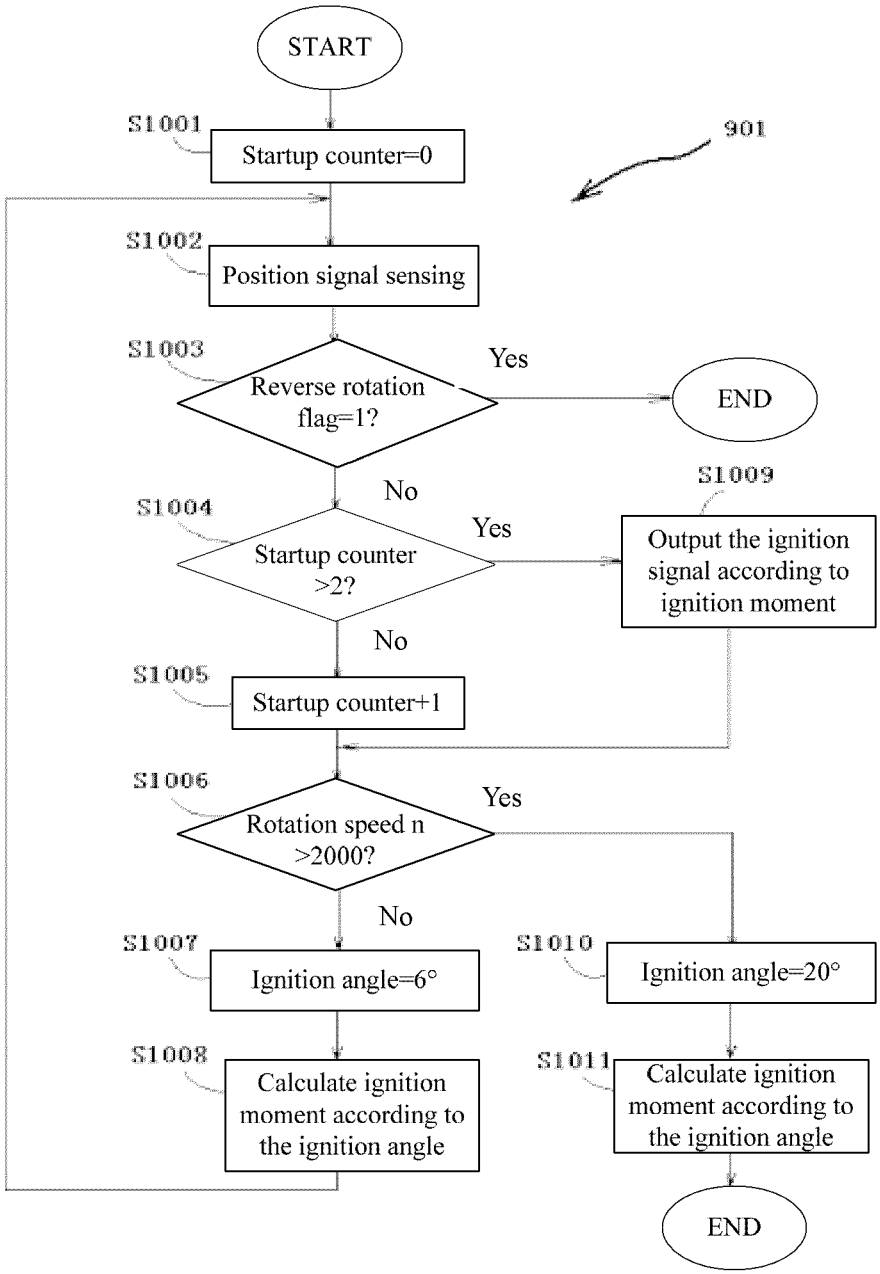
FIG. 10 is the sub-flow chart of startup control according to an embodiment of the invention.
Figure 11:
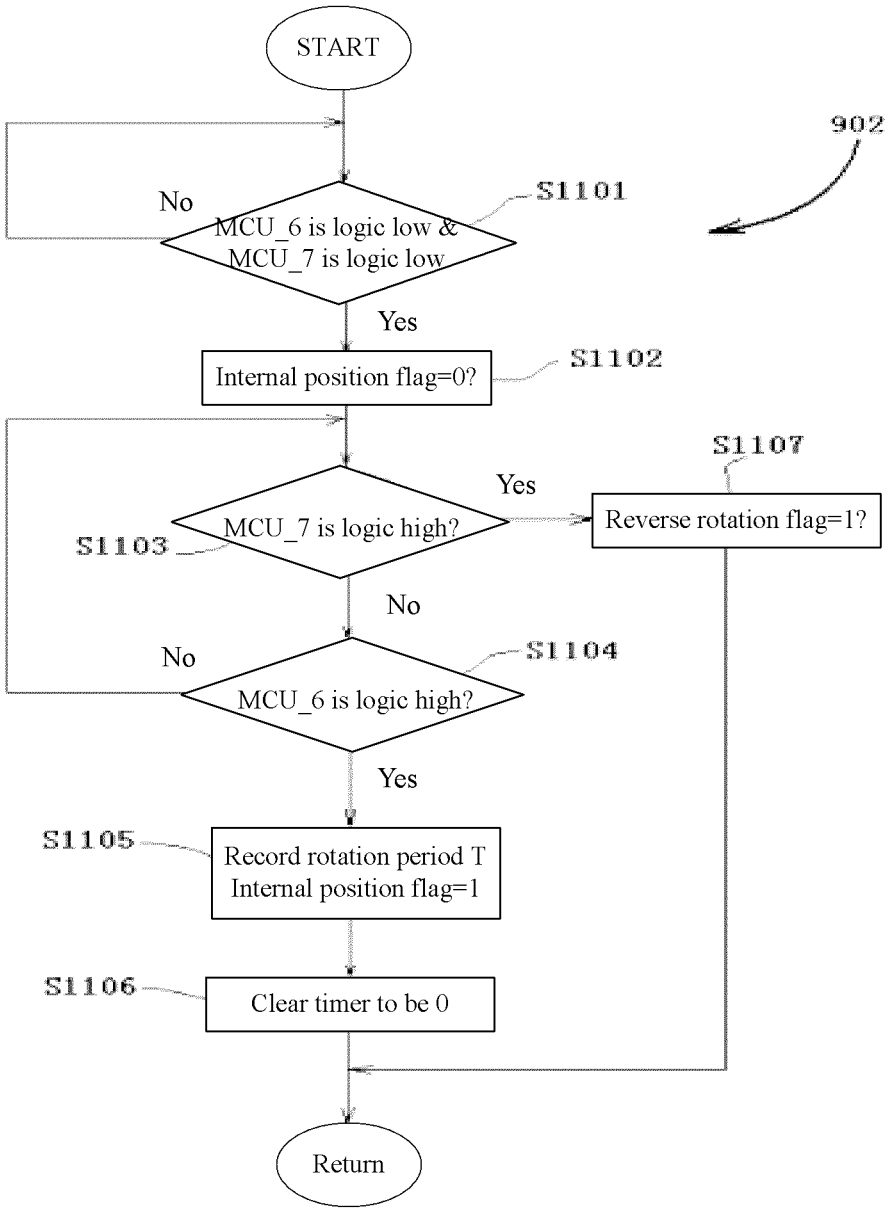
FIG. 11 is the sub-flow chart of position signal sensing according to an embodiment of the invention.

Referring to FIG. 9 to FIG. 11, description will be made for the ignition control process which is carried out by the micro-controller 216 according to an embodiment of the invention in combination with the above description for FIG. 8 as reference.

FIG. 9*a* and FIG. 9*a* shows flow charts of the ignition control according to an embodiment of the invention.

Firstly, in step S900, the system is initialized, and the reverse rotation flag is set to be 0, wherein the reverse rotation flag being 0 represents that the engine is in the state of positive rotation, and the reverse flag being 1 represents that the engine is in the state of reverse rotation.

Then, in step S901, the startup control process is performed.

The control startup sub-process is as shown in FIG. 10. Referring to FIG. 10, firstly, in step S1001, the startup counter is set to be 0.

Then in step S1002, the position signal is sensed. Wherein the position signal sensing sub-process is the same as step S902 shown in FIG. 9*a*, and further description about position signal sensing sub-process is elaborated as follows.

Then in step S1003, it is judged whether the value of the reverse flag is 1 or not.

If the value of the reverse flag is 1, the engine is determined to be in the state of reverse rotation, then all the ignition control process is stopped to halt the engine.

If the value of the reverse flag is 0, then in step S1004, it is judged whether the value of the startup counter is greater than 2 or not.

If the value of the startup counter is greater than 2, then in step S1009, an ignition signal is output according to the ignition moment.

If the value of the startup counter is less than 2 or equals to 2, then in step S1005, the startup counter is increased by 1.

The above step S1004, S1005, and S1009 carry out the function that there is no ignition for the first 2 rounds of the engine's rotation.

Subsequently, in step S1006, it is judged whether the rotation speed of the engine is greater than 2000 r/m.

It should be noted that, the above parameter of 2000 r/m just serves as an example in order to match the mapping relation between the rotation speed and the ignition angle of the engine during startup process of light duty gasoline engine, which corresponds to the partition enclosed by the dot line as shown in FIG. 8.

If the judgment result is that the value of the rotation speed of the engine is less than 2000 r/m, then in step S1007, the ignition angle is set to be 6°.

Then, in step S1008, the next ignition moment is calculated according to the ignition angle; and then the process goes to step S1002 to go on with a new cycle.

If the judgment result is that the value of the rotation speed of the engine is greater than or equals to 2000 r/m, then in step S1010 the ignition angle is set to be 20°.

Subsequently, in step S1006, the next ignition moment is calculated according to the ignition angle.

Finally, the startup control sub-process comes to an end and there goes to the main process.

The step S1006, S1007, S1008, S1010 and S1011 carry out to determine the moment when the execution should switch from startup control sub-process back to main process. As shown in FIG. 8, after the engine enters into the startup control sub-process, the startup control sub-process will be always executed if the rotation speed is less than 2000 r/m. Once the rotation speed is greater than 2000 r/m, the startup control sub-process is stopped.

After the startup control sub-process is executed completely, there goes to step S902 of the main process, position signal is sensed.

The position signal sensing sub-process is shown in FIG. 11. According to FIG. 11, firstly, in step S1101, it is determined if Pin 6 (namely, MCU_6) and Pin 7 (namely, MCU_7) are all logic low.

If NOT, judgment will be made periodically until it is judged that Pin 6 (namely, MCU_6) and Pin 7 (namely, MCU_7) are all logic low and then there goes into step 1102.

In step S1102, the internal position flag is set to 0. It should be noted that, the internal position flag is just made for a more clear function description, and can be omitted in the practical application.

Then, in step S1103, it is judged if MCU_7 changes to logic high or not.

If MCU_7 is logic high, in step S1107, the reverse rotation flag is set to be 1, and there goes to main process, giving an end to the position signal sensing sub-process.

If MCU_7 is logic low, in step S1104, it is judged if MCU_6 changes to logic high or not.

If MCU_6 is not logic high, in step S1103, it is judged again if MCU_7 changes to logic high or not.

If MCU_6 is logic high, in step S1105, the rotation period T is recorded, and the internal position flag is set to be 1.

Finally, in step S1106, the internal tinier inside the micro-controller is cleared to be 0, and there goes to main process, giving an end to the position signal sensing sub-process.

By the execution of the step S902, namely the position signal sensing sub-process, the status of the reverse flag can be determined to indicate the rotation direction of the engine and the rotation period T can be determined to indicate the rotation speed of the engine.

After the position signal sensing sub-process, in step S903 in the main process, it is judged if the reverse rotation flag is 1.

If the reverse rotation flag is 1, representing the reverse rotation of the engine, then all the ignition control process is stopped to allow the engine to be halted.

If the reverse rotation flag is 0, in step S904, it is judged if the cutoff flag is 1.

If cutoff flag is 0, which represents that ignition of the engine is temporarily being suppressed for the current rotation round of the engine, and there goes to step S906, the cutoff flag is set to be 0.

If cutoff flag is 0, in step S905, the ignition signal is output according to the ignition moment, and then in step S906, the cutoff flag is set to be 0.

The aim of the setting of the cutoff flag is to stop outputting the ignition signal temporarily in case of a rotation speed going too high so as to get the rotation speed back to be within an acceptable range for the rotation speed of the engine.

The intention of step S906 is to clear the cutoff flag to be 0, which is equivalent to an initialization of the cutoff flag.

Then, in step S907, it is judged whether the current rotation speed is less than 3000 r/m.

If the current rotation speed is less than 3000 r/m, then in step S908, the ignition angle is set to be 20°.

If the current rotation speed is no less than 3000 r/m, then in step S909, it is further judged whether the current rotation speed is less than 4000 r/m.

If the judgment result is YES for the step S909, the in step S915, the ignition angle is calculated.

With an reference to mapping relation between the rotation speed and the ignition angle of the engine depicted in FIG. 8, when the rotation speed is among 3000 r/m~4000 r/m, the ignition angle is among 20°~30° accordingly. Optionally, difference algorithm can be adopted in step S915 by the way that the curve of the ignition angle between 3000 r/m and 4000 r/m is treated as an approximate straight line, which allows value of the ignition angle to be evenly distributed within the range between 20° and 32°.

If the judgment result is NO for step S909, then in step S910, it is judged whether the rotation speed is less than 8500 r/m.

If the judgment result is YES for step S910, then in step S916, the ignition angle is set to be 32°.

If the judgment result is NO for step S910, then in step S911, it is judged whether the rotation speed is less than 9000 r/m.

If the judgment result is YES for step S911, then in step S917, the ignition angle is set to be 11°.

If the judgment result is NO for step S911, then in step S912, it is judges whether the rotation speed is less than 10000 r/m.

If the judgment result is YES for step S912, then in step S918, the ignition angle is set to be 6°.

If the judgment result is NO for step S912, then in step S913, the cutoff flag is set to be 1.

Subsequently, in step S914, the status of the killing switch is scanned.

After completion of the scan, in step S920, it is judged whether the killing switch takes effect.

If the killing switch takes effect, all of the ignition control process is stopped to allow the engine to be halted.

If the killing switch does not take effect, in step S902, there goes to another cycle of execution.

After completion of the execution of step S915, S916, S917, S918, there all goes to step S919, the ignition moment is calculated according to the ignition angle, and then, there goes to step S914 and the rest steps in the flow chart.

It should be noted that, the ignition angle for the above ignition control process is determined based on the mapping relation between the rotation speed and the ignition angle of the engine depicted in FIG. 8, which is just exemplary and does not limit to the present invention. It should be understood by those skilled in the art that, the mapping relation between the rotation speed and the ignition angle of the engine varies from engine to engine.

Figure 12:
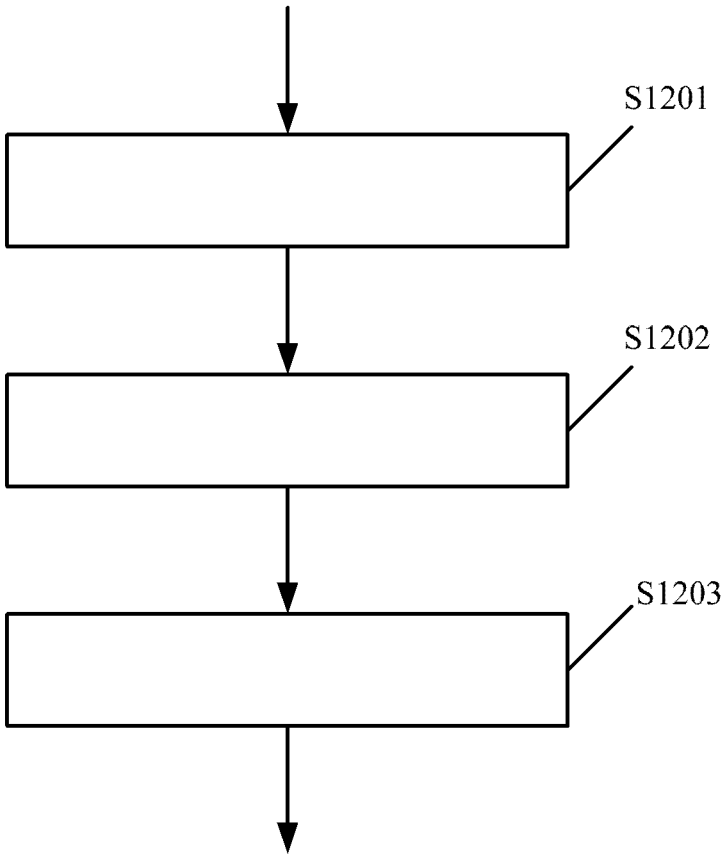
FIG. 12 is the flow chart of method of suppressing engine's reverse rotation during startup process of light duty gasoline engine according to an embodiment of the invention.

FIG. 12 is the flow chart of method of suppressing engine's reverse rotation during startup process of light duty gasoline engine according to one embodiment of the present invention.

Firstly, in step S1201, shaping the positive signal and the negative signal of a second alternating current signal respectively and generating a first position signal and a second position signal.

The second alternating current signal is induced by the trigger coil 214 with rotation of the fly wheel.

The shaping of the positive signal and the negative signal includes rectification, voltage-division, and voltage-stabilization of the positive signal and the negative signal.

Secondly, in step S1202, determining whether the engine is in reverse rotation according to the first position signal and second position signal;

To be specific, firstly, detecting the first position signal and the second signal respectively.

If the first position signal is a low level signal and the second position signal is a high level signal, determining that the engine is in reverse rotation.

If the first position signal is a high level signal and the second position signal is a low level signal, determining that the engine is in positive rotation.

If the engine is rotating reversely, in step S1203, controlling a spark plug to stop igniting.

The embodiments of the present invention have been described above. It is understandable by those skilled in the art that the present invention is not limited to the above specific embodiments, and various modifications or amendments can be made without departing from the scope and spirit of the scope of the attached claims.

What is claimed is:

1. An ignition control device for use with a light duty gasoline engine, which controls a spark plug to generate a spark for ignition of the light duty gasoline engine, wherein said ignition control device comprises:

a charge coil configured to induce a first alternating current signal with rotation of a fly wheel, the surface of said fly wheel comprising a magnetic steel;

a transformer comprising a primary ignition coil and a secondary ignition coil, wherein said secondary ignition coil is connected with said spark plug;

an electric-spark-generating control circuit configured to receive said rectified first alternating current signal and apply a first signal to said primary ignition coil in response to an ignition signal, wherein said secondary ignition coil induces a second signal to control said spark plug to generate a spark;

a trigger coil configured to induce a second alternating current signal with rotation of said fly wheel;

a position sensing circuit configured to shape the positive signal and the negative signal of said second alternating current signal respectively to generate a first position signal and a second position signal, and provide said first position signal and said second position signal to a micro-controller;

the micro-controller configured to determine an ignition moment according to said first position signal to provide said ignition signal to said electric-spark-generating control circuit, and further configured to determine whether said engine is in reverse rotation according to said first position signal and second position signal and control a spark plug to stop igniting if said engine is rotating reversely.

2. The ignition control device of claim 1, wherein said micro-controller is further configured to sample said first position signal and said second position signal;

and control said spark plug to stop igniting if said second position signal is a high level signal and said first position signal is a low level signal.

3. The ignition control device of claim 1, wherein said ignition control device comprises a killing control circuit configured to provide a killing signal to said micro-controller in response to a user's operation, and said micro-controller configured to control said spark plug to stop igniting according to said killing signal.

4. The ignition control device of claim 3, wherein said killing control circuit comprises a killing switch, and a first terminal of said killing switch is connected to the GROUND, and a second terminal of said killing switch is connected to said micro-controller, wherein said micro-controller is configured to control said spark plug to stop igniting upon said killing switch is pressed by a user.

5. The ignition control device of claim 4, wherein said killing control circuit further comprises a first stabilivolt connected with said second terminal of said killing switch.

6. The ignition control device of claim 1, wherein said position sensing circuit comprises a first rectifying unit, a first voltage-dividing unit, a first voltage-stabilizing unit, a second rectifying unit, a second voltage-dividing unit and a second voltage-stabilizing unit, wherein said first rectifying unit, said first voltage-dividing unit and said first voltage-stabilizing unit are configured to shape the positive signal of said second alternating current signal into said first position signal and provide said first position signal to said micro-controller, and said second rectifying unit, said second voltage-dividing unit and said second voltage-stabilizing unit are configured to shape the negative signal of said second alternating current signal into said second position signal and provide said second position signal to said micro-controller; wherein said shaping of the positive signal and the negative signal includes rectification, voltage-division, and voltage-stabilization of the positive signal and the negative signal.

7. The ignition control device of claim 6, wherein said position sensing circuit further comprises a first filter unit and a second filter unit, and said first filter unit is configured to filter said first position signal and provide said filtered first position signal to said micro-controller, and said second filter unit is configured to filter said second position signal and provide said filtered second position signal to said micro-controller.

8. The ignition control device of claim 1, wherein said electric-spark-generating control circuit comprises an electronic switch unit and an energy storage unit, and said energy storage unit is configured to store said rectified first alternating current signal, and said electronic switch unit is configured to be switched on in response to said ignition signal from said micro-controller so that said energy storage unit discharges to apply said first signal to said primary ignition coil.

9. The ignition control device of claim 8, wherein said energy storage unit comprises an ignition capacitor and said ignition capacitor has a high value of permissible voltage.

10. The ignition control device of claim 8, wherein said electronic switch unit comprises a thyristor and a first resistor set, and the cathode and anode of said thyristor are connected across two terminals of said charge coil, and the gate of said thyristor is connected, via said first resistor set, to an ignition control port of said micro-controller, from which said ignition signal is output, and the gate of said thyristor is further connected to an auxiliary ignition control port of said micro-controller via a conducting wire; wherein said micro-controller is configured to control said ignition control port to output a high level signal and set said auxiliary ignition control port to be a high-impedance state in time of need of ignition from said spark plug, and to control said ignition control port and said auxiliary ignition control port to output low level signals when no ignition from said spark plug is needed.

11. A method of suppressing the reverse rotation of an engine during startup of a light duty gasoline engine, comprising the steps:

a. shaping the positive signal and the negative signal of a second alternating current signal respectively to generate a first position signal and a second position signal, wherein said second alternating current signal is induced by a trigger coil with rotation of a fly wheel, and said shaping of the positive signal and the negative signal includes rectification, voltage-division, and voltage-stabilization of the positive signal and the negative signal;

b. determining whether said engine is in reverse rotation according to said first position signal and second position signal; and c. controlling a spark plug to stop igniting if said engine is rotating reversely.

12. The method of claim 11, wherein said shaping of the positive signal and the negative signal further comprises filtering of the positive signal and the negative signal.

13. The method of claim 11, wherein said step b further comprises the steps of:

i. detecting said first position signal and said second signal respectively;

ii. determining that said engine is in reverse rotation, if said first position signal is a low level signal and said second position signal is a high level signal; and iii. determining that said engine is in positive rotation, if said first position signal is a high level signal and said second position signal is a low level signal.

* * * * *